US012765675B2

(12) United States Patent
Palma

(10) Patent No.: US 12,765,675 B2
(45) Date of Patent: Oct. 20, 2026

(54) ROLLING PUMP UP CHAIR WITH HANDLE DEVICE

(71) Applicant: Igal Palma, Stockton, CA (US)

(72) Inventor: Igal Palma, Stockton, CA (US)

( * ) Notice: Subject to any disclaimer, the term of this patent is extended or adjusted under 35 U.S.C. 154(b) by 152 days.

(21) Appl. No.: 18/754,243

(22) Filed: Jun. 26, 2024

(65) Prior Publication Data

US 2025/0000262 A1 Jan. 2, 2025

Related U.S. Application Data

(60) Provisional application No. 63/510,433, filed on Jun. 27, 2023.

(51) Int. Cl.

| | |
|---|---|
| ***A47C 9/10*** | (2006.01) |
| ***A47C 3/30*** | (2006.01) |
| ***A47C 4/04*** | (2006.01) |
| ***A47C 4/18*** | (2006.01) |
| *A47C 7/00* | (2006.01) |

(52) U.S. Cl.

CPC ..... *A47C 3/30* (2013.01); *A47C 4/04* (2013.01); *A47C 7/006* (2013.01)

(58) Field of Classification Search

CPC .. A47C 4/04; A47C 7/006; A47C 4/52; A47C 7/50; A47C 9/105; A45B 5/00; A45B 2009/005; A45B 2009/007; A45B 25/16

See application file for complete search history.

(56) References Cited

U.S. PATENT DOCUMENTS

| | | | | |
|---|---|---|---|---|
| 1,123,872 | A | 1/1915 | Hazel | |
| 2,319,992 | A * | 5/1943 | Hubbard | B25G 1/04 294/174 |
| 3,326,601 | A | 6/1967 | Parkinson | |
| 3,635,233 | A * | 1/1972 | Robertson | A61H 3/02 135/71 |
| 3,736,021 | A | 5/1973 | MacLaren | |
| 3,880,463 | A | 4/1975 | Shephard | |
| 4,634,178 | A | 1/1987 | Carney | |
| 6,601,865 | B1 * | 8/2003 | Harper | A61G 5/128 297/423.26 |
| 7,055,847 | B2 * | 6/2006 | Miller | B62B 3/022 248/161 |
| 7,389,997 | B2 * | 6/2008 | Johnson | A45C 5/14 280/30 |

(Continued)

*Primary Examiner* — Shin H Kim

(74) *Attorney, Agent, or Firm* — Brennan, Manna & Diamond, LLC

(57) ABSTRACT

A stool with adjustable handle device is disclosed which comprises a stool component that is configured in a round base shape of a stool or chair. The adjustable handle can be a telescoping or accordion-style configuration and acts to control the position of the stool component. Further, the adjustable handle can be used to move the stool component across the floor rather than bending over and moving it and risking discomfort. Thus, the stool component is relatively small, portable, and adjustable via the adjustable handle. The adjustable handle and the stool component can be collapsed and compacted for storage. Further, the stool component comprises a storage hook for hanging the device on a wall with ease. An optional folding back pad component can be included for additional support, as well a plurality of wheels to make the device mobile.

13 Claims, 3 Drawing Sheets

(56) References Cited

U.S. PATENT DOCUMENTS

| | | | | |
|---|---|---|---|---|
| 7,523,949 | B1 * | 4/2009 | Galfin | A45C 9/00 280/35 |
| 8,573,454 | B2 * | 11/2013 | Talavera Tolentino | A45F 4/02 224/155 |
| 8,777,306 | B2 * | 7/2014 | Rahm | A47C 7/50 280/47.25 |
| 9,357,820 | B2 * | 6/2016 | Pao | A45B 5/00 |
| 9,629,770 | B1 * | 4/2017 | Dyer | A61G 7/1074 |
| 10,717,491 | B1 * | 7/2020 | Neville | B62K 15/008 |
| 11,470,971 | B2 * | 10/2022 | Saad | B60B 33/0068 |
| 11,572,217 | B2 * | 2/2023 | Lin | A47F 5/005 |
| 12,507,808 | B2 * | 12/2025 | Pao | A45B 5/00 |
| 2005/0088029 | A1 * | 4/2005 | Stokes | A47C 9/025 297/461 |
| 2005/0269857 | A1 | 12/2005 | Buis | |
| 2009/0194960 | A1 * | 8/2009 | Peterson | B62K 3/002 280/87.041 |
| 2010/0007104 | A1 * | 1/2010 | Bennett | A61G 5/127 280/7.15 |
| 2012/0267875 | A1 * | 10/2012 | Mazar | B60N 2/2848 280/643 |
| 2013/0113248 | A1 * | 5/2013 | Rahm | A47C 7/50 297/217.1 |
| 2014/0060598 | A1 * | 3/2014 | Pao | A45B 5/00 135/66 |
| 2015/0196103 | A1 * | 7/2015 | Pao | A47C 9/105 297/55 |
| 2018/0130163 | A1 * | 5/2018 | Kohn | G06Q 30/0242 |
| 2019/0208874 | A1 * | 7/2019 | Ritter | A45B 9/02 |
| 2019/0322411 | A1 * | 10/2019 | Lin | A47F 5/0018 |
| 2020/0179776 | A1 * | 6/2020 | Roiser | A45B 9/00 |
| 2025/0000262 | A1 * | 1/2025 | Palma | A47C 3/30 |

* cited by examiner

ROLLING PUMP UP CHAIR WITH HANDLE DEVICE

CROSS-REFERENCE TO RELATED APPLICATION

The present application claims priority to, and the benefit of, U.S. Provisional Application No. 63/510,433, which was filed on Jun. 27, 2023, and is incorporated herein by reference in its entirety.

FIELD OF THE INVENTION

The present invention relates generally to the field of stool with adjustable handle devices. More specifically, the present invention relates to a pumping chair or stool with a telescopic adjustable handle. Accordingly, the present disclosure makes specific reference thereto. Nonetheless, it is to be appreciated that aspects of the present invention are also equally applicable to other like applications, devices and methods of manufacture.

BACKGROUND

By way of background, this invention relates to improvements in stool with adjustable handle devices. Generally, offices, especially medical offices, may have several small stools that employees sit on during work hours. The stools are small and cannot be adjusted to accommodate height. Accordingly, people may develop back pain and discomfort using these types of stools. Further, bending over to move the stool or put it in storage can require significant time and energy if the process is repeated multiple times through the day.

Accordingly, a stool constructed in accordance with the invention can be easily transported to be used for camping, picnics, fairs or similar occasions where a stool is desirable. Further, it is often necessary for people to interact with machines or other people on a temporary basis in an office setting. These interactions occur in office settings constantly throughout the world and typically require a sitting position for at least one of the people involved in the interaction. Accordingly, a movable stool is typically used and users must move and manually manipulate the stool as needed, expending energy and developing discomfort at times.

Accordingly, there is a demand for an improved stool with adjustable handle device that allows users to adjust the position of the stool via the handle rather than bending over and pushing it. More particularly, there is a demand for a stool with adjustable handle device that users can compact and place on a storage hook with case.

Therefore, there exists a long felt need in the art for a stool with adjustable handle device that provides users with a pumping chair or stool with a telescopic adjustable handle. There is also a long felt need in the art for a stool with adjustable handle device that allows users to adjust the position of the stool via the handle rather than bending over and pushing it. Further, there is a long felt need in the art for a stool with adjustable handle device that features wheels on the base to facilitate movement and allow the user to put the stool in a comfortable position for sitting. Moreover, there is a long felt need in the art for a device that includes a small hook for wall mounted storage, enabling users to compact the stool and store it out of the way when not in use. Further, there is a long felt need in the art for a stool with adjustable handle device that provides an adjustable handle with an accordion-style configuration. Finally, there is a long felt need in the art for a stool with adjustable handle device that includes an optional folding back pad for additional support.

The subject matter disclosed and claimed herein, in one embodiment thereof, comprises a stool with adjustable handle device. The device is a modified stool or chair with an adjustable handle that can be raised or lowered, as needed. The stool with adjustable handle device comprises a stool component that is configured in a round base shape of a stool or chair. The adjustable handle can be a telescoping or accordion-style configuration and acts to control the position of the stool component. Further, the adjustable handle can be used to move the stool component across the floor rather than bending over and moving it and risking discomfort. Thus, the stool component is relatively small, portable, and adjustable via the adjustable handle. The adjustable handle and the stool component can be collapsed and compacted for storage. Further, the stool component comprises a storage hook for hanging the device on a wall with ease. An optional folding back pad component can be included for additional support, as well a plurality of wheels to make the device mobile.

In this manner, the stool with adjustable handle device of the present invention accomplishes all of the forgoing objectives and provides users with a device that provides a stool with an adjustable handle. The device is a stool that is adjusted via the handle. The device can comprise a plurality of wheels.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a stool with adjustable handle device. The device is a modified stool or chair with an adjustable handle that can be raised or lowered, as needed. The stool with adjustable handle device comprises a stool component that can be manipulated via the adjustable handle. Further, the adjustable handle can be used to move the stool component across the floor. Thus, the stool component is relatively small, portable, and adjustable via the adjustable handle. Further, the adjustable handle and the stool component can be collapsed and compacted for storage.

In one embodiment, the stool with adjustable handle device allows users to adjust the height of the stool via the adjustable handle rather than bending over and pushing it. Further, the adjustable handle can be used to move the device across the floor rather than bending over and moving it. Accordingly, users can manipulate the stool (i.e., moving, adjusting, raising, lowering, etc.), solely via the adjustable handle, saving users significant time and energy and preventing pain and discomfort.

In one embodiment, the stool with adjustable handle device comprises a stool component that is configured in a round base shape of a stool or chair seat with a vertical center support and a plurality of legs arranged in a radial configuration to support the stool component off the ground during use. The stool component comprises an exterior surface, an interior surface, and a side edge along the circumference of the circular stool component. However, the stool component can be any suitable shape and size as is known in the art, as long as the stool component is sized and shaped to be sat on by a user during use.

In one embodiment, the stool component is adjustable for height by lengthening or shortening the vertical center support via telescoping action, by a scissor-lift mechanism, or by rotation of a threaded connection, etc. In all these embodiments, the adjustable handle is secured to an activator component which acts to engage the telescoping action, the scissor-lift mechanism, or the threaded connection to raise or lower the stool component, as needed. Typically, when the telescoping action is utilized, the activator component is pneumatic and comprises an air cylinder to telescopically raise and lower the stool component.

In one embodiment, the adjustable handle is utilized when adjusting and moving the device from place to place. The adjustable handle is secured to the vertical center support via any suitable securing means as is known in the art, such as welding, adhesives, mechanical fasteners, etc. Further, the adjustable handle can be any suitable handle as is known in the art, as long as the adjustable handle allows a user to securely and comfortably manipulate the device with their hands. Further, the length and diameter of the adjustable handle may vary widely, as it is important only that it be reasonably comfortable to hold with a hand and allow manipulation of the device with relative ease. Additionally, the adjustable handle comprises gripping texture area or other suitable non-slip resistant areas to provide a non-slip grip for a user.

In one embodiment, the adjustable handle is adjustable and the height of the handle can be raised or lowered, as needed. The adjustable handle can also be collapsed for storage. Typically, the adjustable handle can comprise a telescoping configuration or an accordion-style configuration. In the telescoping configuration, the telescoping segments are extended or retracted and then secured via a slip lock component in the desired height or in a completely collapsed configuration. In the accordion-style configuration, each of the handle segments comprise pin connections, which allow the handle to be folded upon itself and then secured with a loop or tie to the vertical center support for storage. In either of these configurations, the handle can be raised, lowered, or collapsed and stored as needed, depending on the needs and/or wants of a user. Accordingly, the stool component is of varying shape which contains a handle, either integral, or attached, as to allow collapse and expansion of the stool device using a single hand.

In one embodiment, the plurality of legs each comprise a wheel or caster to allow the device to move freely, as needed. Typically, the legs extend radially and each fasten to the wheel/caster. The wheels/casters allow the device to swivel and roll easily across a floor or other suitable surface. Further, the adjustable handle is utilized by a user to move the device via the wheels/casters across the floor rather than a user bending over and moving/pushing it and risking discomfort. Additionally, the wheels/casters can be locked in place for safety, to prevent the device from inadvertently rolling.

In one embodiment, the stool with adjustable handle device comprises an optional folding back pad that can be secured to the stool component or the adjustable handle for use. The folding back pad can be releasably secured via screws, bolts, pins, etc., or any other suitable fasteners as is known in the art. The folding back pad can be any suitable shape and size as is known in the art. Further, the folding back pad can be removed and folded for storage when not in use.

In one embodiment, the stool component and the adjustable handle are completely collapsible for storage. Specifically, the adjustable handle can be telescoped down or folded down, depending on the configuration at use. Then, the vertical center support is shortened, such that the stool component rests against the plurality of legs. Once in position, the adjustable handle and stool component can be locked into place. Further, a storage hook or loop secured to the stool component can be utilized to hang the device to a hook or nail on a wall or other suitable area for storage.

In one embodiment, the stool with adjustable handle device comprises at least one storage container. The storage containers can be any suitable shape and size as is known in the art and any suitable number of storage containers can be secured to the device. Typically, the storage containers are secured to the vertical center support and/or to the plurality of legs. The storage containers can be releasably secured to the device via snaps, pins, bolts, adhesives, etc. Thus, the storage containers can be removed and the device collapsed for storage, as needed.

In one embodiment, the stool with adjustable handle device is manufactured from titanium, aluminum, steel, plastic, fiber-reinforced plastic, or other suitable materials as is known in the art, or a combination of such materials.

In yet another embodiment, the stool with adjustable handle device comprises a plurality of indicia.

In yet another embodiment, a method of adjusting a stool via an adjustable handle is disclosed. The method includes the steps of providing a stool with adjustable handle device comprising a stool component with wheels and adjustable handle. The method also comprises adjusting the height of the stool component via the adjustable handle. Further, the method comprises moving the stool component via the adjustable handle. The method also comprises collapsing the adjustable handle and stool component. Finally, the method comprises securing the collapsed stool component and adjustable handle to a wall for storage.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1A:
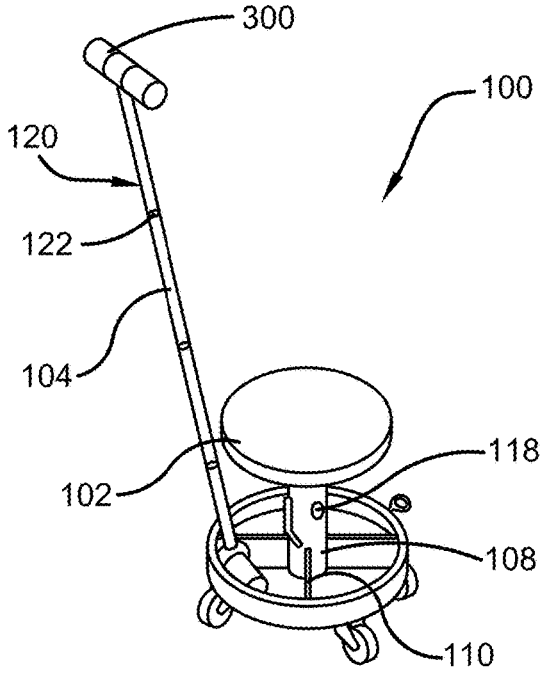
FIGS. 1A-B illustrate a perspective view of one embodiment of the stool with adjustable handle device of the present invention showing the telescopic handle in accordance with the disclosed architecture.
Figure 1B:
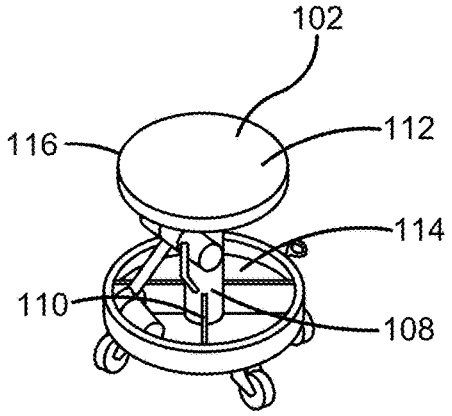
Figure 2A:
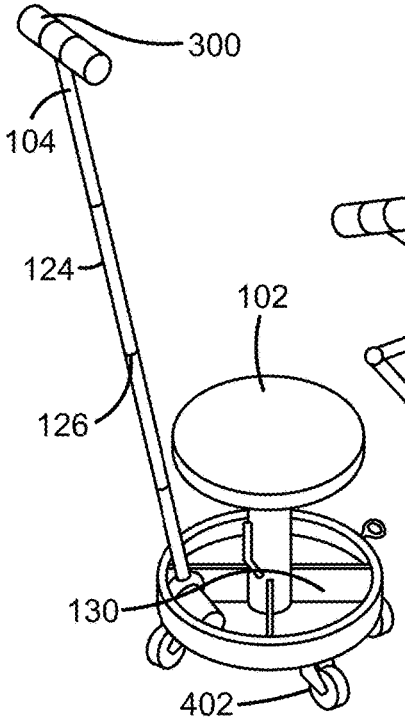
FIGS. 2A-C illustrate a perspective view of one embodiment of the stool with adjustable handle device of the present invention showing the accordion-style handle in accordance with the disclosed architecture.
Figure 2B:
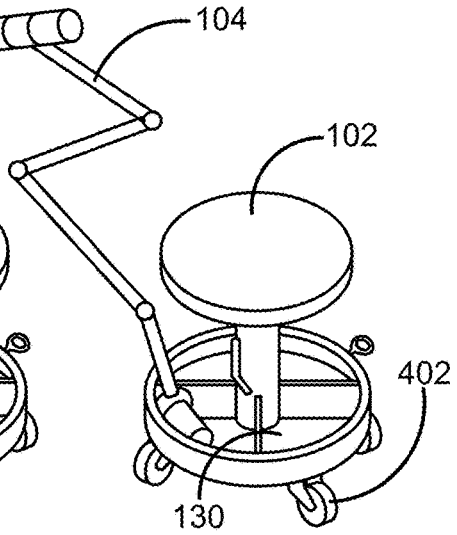
Figure 2C:
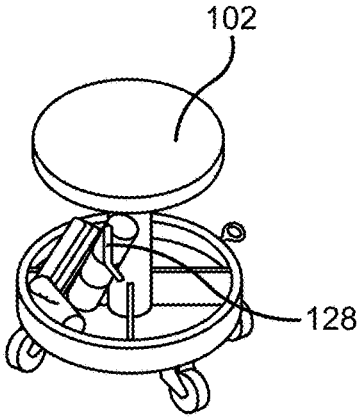

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a stool with adjustable handle device that provides users with a pumping chair or stool with a telescopic adjustable handle. There is also a long felt need in the art for a stool with adjustable handle device that allows users to adjust the position of the stool via the handle rather than bending over and pushing it. Further, there is a long felt need in the art for a stool with adjustable handle device that features wheels on the base to facilitate movement and allow the user to put the stool in a comfortable position for sitting. Moreover, there is a long felt need in the art for a device that includes a small hook for wall mounted storage, enabling users to compact the stool and store it out of the way when not in use. Further, there is a long felt need in the art for a stool with adjustable handle device that provides an adjustable handle with an accordion-style configuration. Finally, there is a long felt need in the art for a stool with adjustable handle device that includes an optional folding back pad for additional support.

The present invention, in one exemplary embodiment, is a novel stool with adjustable handle device. The stool with adjustable handle device comprises a stool component that is configured in a round base shape of a stool or chair. The adjustable handle can be a telescoping or accordion-style configuration and acts to control the position of the stool component. The adjustable handle and the stool component can be collapsed and compacted for storage. Further, the stool component comprises a storage hook for hanging the device on a wall with ease. An optional folding back pad component can be included for additional support, as well a plurality of wheels to make the device mobile. The present invention also includes a novel method of adjusting a stool via an adjustable handle. The method includes the steps of providing a stool with adjustable handle device comprising a stool component with wheels and adjustable handle. The method also comprises adjusting the height of the stool component via the adjustable handle. Further, the method comprises moving the stool component via the adjustable handle. The method also comprises collapsing the adjustable handle and stool component. Finally, the method comprises securing the collapsed stool component and adjustable handle to a wall for storage.

Referring initially to the drawings, FIGS. 1A-B and 2A-C illustrate a perspective view of one embodiment of the stool with adjustable handle device 100 of the present invention. In the present embodiment, the stool with adjustable handle device 100 is an improved stool with adjustable handle device 100 that provides a user 106 with a stool that is manipulated solely by the handle. Specifically, the stool with adjustable handle device 100 comprises a stool component 102 and an attached adjustable handle 104. Thus, the stool component 102 is relatively small, portable, and adjustable via the adjustable handle 104. Further, the adjustable handle 104 and the stool component 102 can be collapsed and compacted for storage.

Generally, the stool with adjustable handle device 100 allows users 106 to adjust the height of the stool component 102 via the adjustable handle 104 rather than bending over and pushing it. Further, the adjustable handle 104 can be used to move the device 100 across the floor rather than bending over and moving it. Accordingly, users 106 can manipulate the stool component 102 (i.e., moving, adjusting, raising, lowering, etc.), solely via the adjustable handle 104, saving users 106 significant time and energy and preventing pain and discomfort.

Further, the stool with adjustable handle device 100 comprises a stool component 102 that is configured in a round base shape of a stool or chair seat with a vertical center support 108 and a plurality of legs 110 arranged in a radial configuration to support the stool component 102 off the ground during use. The stool component 102 comprises an exterior surface 112, an interior surface 114, and a side edge 116 along the circumference of the circular stool component 102. However, the stool component 102 can be any suitable shape and size as is known in the art, as long as the stool component 102 is sized and shaped to be sat on by a user 106 during use.

Additionally, the stool component 102 is adjustable for height by lengthening or shortening the vertical center support 108 via telescoping action, by a scissor-lift mechanism, or by rotation of a threaded connection, etc. In all these embodiments, the adjustable handle 104 is secured to an activator component 118 which acts to engage the telescoping action, the scissor-lift mechanism, or the threaded connection to raise or lower the stool component 102, as needed. Typically, when the telescoping action is utilized, the activator component 118 is pneumatic and comprises an air cylinder to telescopically raise and lower the stool component 102.

Generally, the adjustable handle 104 is adjustable and the height of the handle 104 can be raised or lowered, as needed. The adjustable handle 104 can also be collapsed for storage. Typically, the adjustable handle 104 can comprise a telescoping configuration or an accordion-style configuration. In the telescoping configuration, the telescoping segments 120 are extended or retracted and then secured via a slip lock component 122 in the desired height or in a completely collapsed configuration. Accordingly, the handle 104 comprises at least one telescoping segment 120 that allows the total length of the handle 104 to be extended or retracted. Each telescoping segment 120 is hollow and has a slip lock component 122 for locking the segment 120 at a specific length. Further, the slip lock component 122 is released by means of pressing or turning the slip lock component 122. The at least one telescoping segments 120 allow the handle 104 to have a length from approximately three feet to six feet fully extended, allowing a user 106 to set the device 100 at a desired length. Thus, the handle 104 is approximately three feet in length but can be adjusted to a length of approximately six feet, if needed.

In the accordion-style configuration, each of the handle segments 124 comprise pin connections 126, which allow the handle 104 to be folded upon itself and then secured with a loop or tie 128 to the vertical center support 108 for storage. In either of these configurations, the handle 104 can be raised, lowered, or collapsed and stored as needed, depending on the needs and/or wants of a user 106. Accordingly, the stool component 102 is of varying shape which contains a handle 104, either integral, or attached, as to allow collapse and expansion of the stool device 100 using a single hand.

In one embodiment, the stool with adjustable handle device 100 comprises at least one storage container 130. The storage containers 130 can be any suitable shape and size as is known in the art and any suitable number of storage containers 130 can be secured to the device 100. Typically, the storage containers 130 are secured to the vertical center support 108 and/or to the plurality of legs 110. The storage containers 130 can be releasably secured to the device 100 via snaps, pins, bolts, adhesives, etc. Thus, the storage containers 130 can be removed and the device 100 collapsed for storage, as needed.

Figure 3:
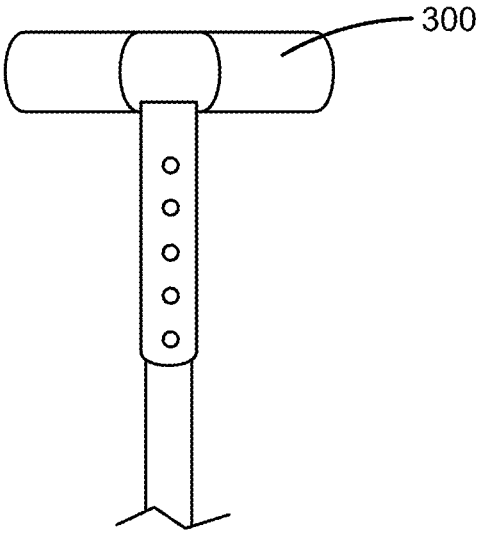
FIG. 3 illustrates a perspective view of one embodiment of the stool with adjustable handle device of the present invention showing the adjustable handle in accordance with the disclosed architecture.

As shown in FIG. 3, the adjustable handle 104 is utilized when adjusting and moving the device 100 from place to place. The adjustable handle 104 is secured to the vertical center support 108 via any suitable securing means as is known in the art, such as welding, adhesives, mechanical fasteners, etc. Further, the adjustable handle 104 can be any suitable handle as is known in the art, as long as the adjustable handle 104 allows a user 106 to securely and comfortably manipulate the device 100 with their hands. Further, the length and diameter of the adjustable handle 104 may vary widely, as it is important only that it be reasonably comfortable to hold with a hand and allow manipulation of the device 100 with relative case. Additionally, the adjustable handle 104 comprises a gripping texture area 300 or other suitable non-slip resistant areas to provide a non-slip grip for a user 106.

Figure 4:
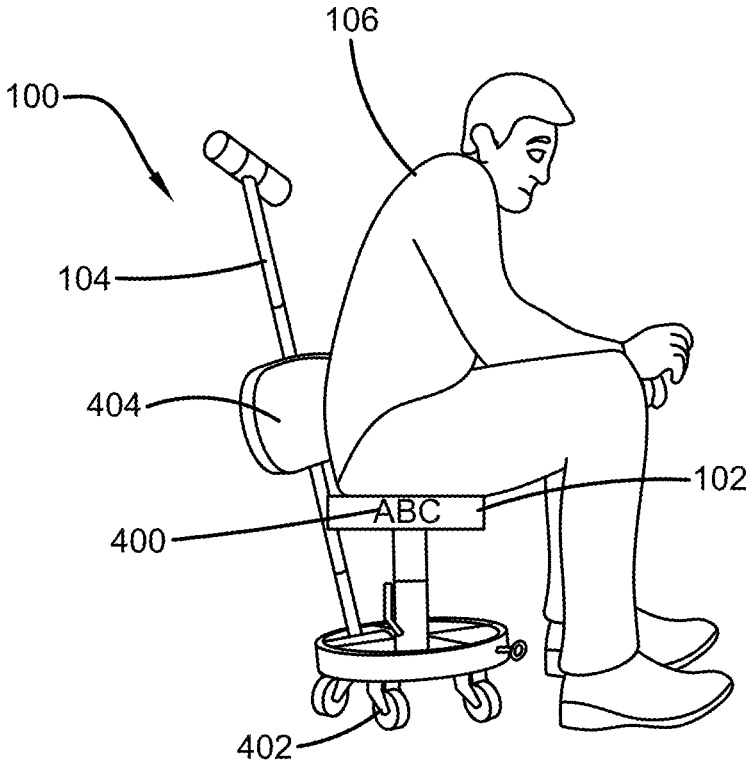
FIG. 4 illustrates a perspective view of one embodiment of the stool with adjustable handle device of the present invention showing the optional folding back pad in accordance with the disclosed architecture.

As shown in FIG. 4, the plurality of legs 110 each comprise a wheel or caster 402 to allow the device 100 to move freely, as needed. Typically, the legs 110 extend radially and each fasten to the wheel/caster 402. The wheels/casters 402 allow the device 100 to swivel and roll easily across a floor or other suitable surface. Specifically, the plurality of wheels 402 may rotate, swivel, and pivot, based on a user's preference. The plurality of wheels 402 can be secured to the legs 110 via any suitable securing means as is known in the art, such as bolts, screws, pins, etc. Further, any suitable wheels 402 can be utilized as is known in the art, such as castors, rollers, swivel wheels, etc. Further, the adjustable handle 104 is utilized by a user 106 to move the device 100 via the wheels/casters 402 across the floor rather than a user 106 bending over and moving/pushing it and risking discomfort. Additionally, the wheels/casters 402 can be locked in place for safety, to prevent the device 100 from inadvertently rolling.

In another embodiment, the stool with adjustable handle device 100 comprises an optional folding back pad 404 that can be secured to the stool component 102 or the adjustable handle 104 for use. The folding back pad 404 can be releasably secured via screws, bolts, pins, etc., or any other suitable fasteners as is known in the art. The folding back pad 404 can be any suitable shape and size as is known in the art. Further, the folding back pad 404 can be removed and folded for storage when not in use.

In yet another embodiment, the stool with adjustable handle device 100 comprises a plurality of indicia 400. The stool component 102 of the device 100 may include advertising, a trademark, or other letters, designs, or characters, printed, painted, stamped, or integrated into the stool component 102, or any other indicia 400 as is known in the art. Specifically, any suitable indicia 400 as is known in the art can be included, such as but not limited to, patterns, logos, emblems, images, symbols, designs, letters, words, characters, animals, advertisements, brands, etc., that may or may not be stool, adjustable handle, or brand related.

Figure 5:
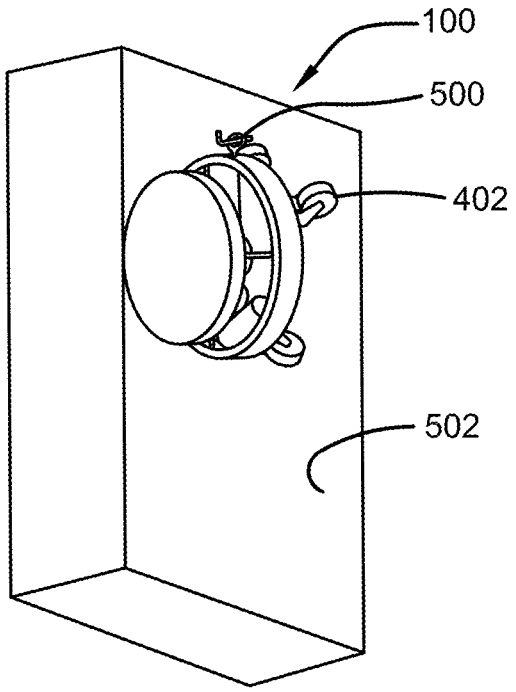
FIG. 5 illustrates a perspective view of one embodiment of the stool with adjustable handle device of the present invention showing the device collapsed and stored on a wall in accordance with the disclosed architecture.

As shown in FIG. 5, the stool with adjustable handle device 100 is manufactured from titanium, aluminum, steel, plastic, fiber-reinforced plastic, or other suitable materials as is known in the art, or a combination of such materials.

Further, the stool component 102 and the adjustable handle 104 are completely collapsible for storage. Specifically, the adjustable handle 104 can be telescoped down or folded down, depending on the configuration at use. Then, the vertical center support 108 is shortened, such that the stool component 102 rests against the plurality of legs 110. Once in position, the adjustable handle 104 and stool component 102 can be locked into place. Further, a storage hook or loop 500 secured to the stool component 102 can be utilized to hang the device 100 to a hook or nail on a wall 502 or other suitable area for storage.

Figure 6:
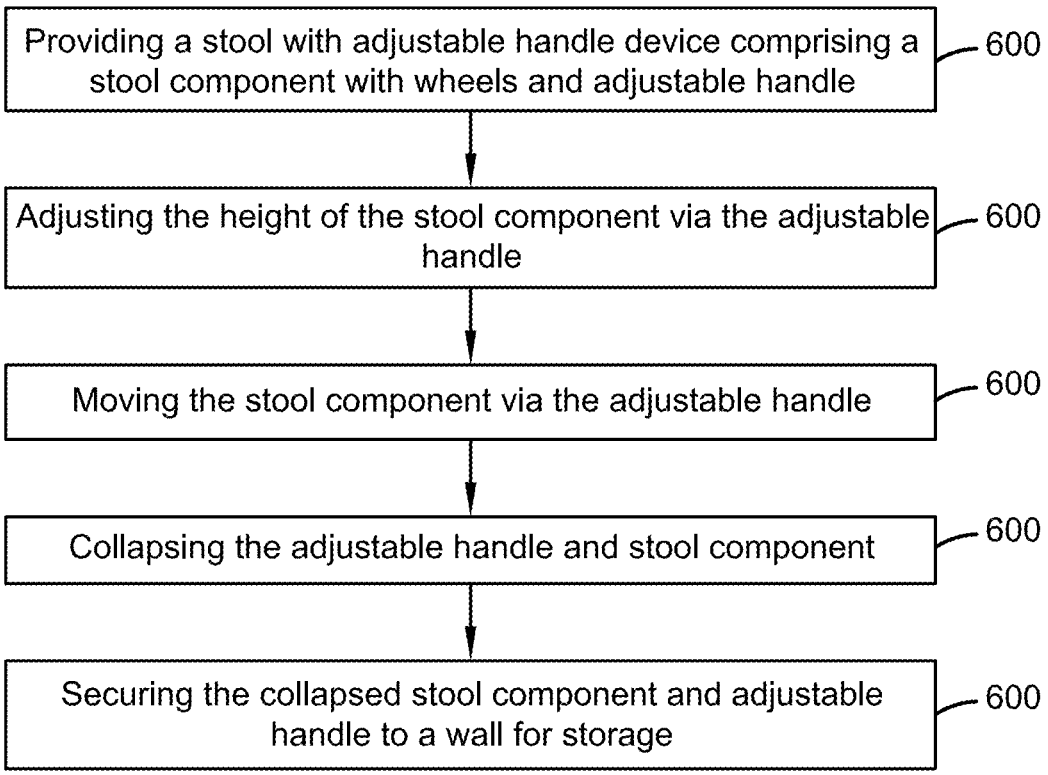
FIG. 6 illustrates a flowchart showing the method of adjusting a stool via an adjustable handle in accordance with the disclosed architecture.

FIG. 6 illustrates a flowchart of the method adjusting a stool via an adjustable handle. The method includes the steps of at 600, providing a stool with adjustable handle device comprising a stool component with wheels and adjustable handle. The method also comprises at 602, adjusting the height of the stool component via the adjustable handle. Further, the method comprises at 604, moving the stool component via the adjustable handle. The method also comprises at 606, collapsing the adjustable handle and stool component. Finally, the method comprises at 608, securing the collapsed stool component and adjustable handle to a wall for storage.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "stool with adjustable handle device", "stool device", "adjustable handle device", and "device" are interchangeable and refer to the stool with adjustable handle device 100 of the present invention.

Notwithstanding the forgoing, the stool with adjustable handle device 100 of the present invention can be of any suitable size and configuration as is known in the art without affecting the overall concept of the invention, provided that it accomplishes the above stated objectives. One of ordinary skill in the art will appreciate that the stool with adjustable handle device 100 as shown in FIGS. 1-6 is for illustrative purposes only, and that many other sizes and shapes of the stool with adjustable handle device 100 are well within the scope of the present disclosure. Although the dimensions of the stool with adjustable handle device 100 are important design parameters for user convenience, the stool with adjustable handle device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A stool with adjustable handle device that provides a user with a stool manipulated solely by a handle, the stool with adjustable handle device comprising:

a stool component, wherein the stool component comprises an exterior surface, an interior surface, and a side edge along a circumference of the stool component;

at least one storage container; and adjustable handle, wherein the adjustable handle is secured to an activator component which acts to engage the telescoping action, the scissor-lift mechanism, or the threaded connection to raise or lower the stool component, as needed;

wherein the adjustable handle is secured to the stool component and can act to manipulate the stool component to move and adjust the stool component as needed;

wherein the stool component is configured in a round base shape with a vertical center support and a plurality of legs arranged in a radial configuration to support the stool component off ground during use;

wherein the stool component is adjustable for height by lengthening or shortening the vertical center support via telescoping action, by a scissor-lift mechanism, or by rotation of a threaded connection;

wherein the at least one storage container can be secured to the vertical center support or to the plurality of legs; and further wherein the stool component and the adjustable handle can be collapsed and compacted for storage.

2. The stool with adjustable handle device of claim 1, wherein the adjustable handle comprises a telescoping configuration with a plurality of telescoping segments that are extended or retracted and then secured via a slip lock component in a desired height or in a completely collapsed configuration.

3. The stool with adjustable handle device of claim 1, wherein the adjustable handle comprises an accordion-style configuration, wherein each of a plurality of handle segments comprise pin connections, which allow the adjustable handle to be folded upon itself and then secured with a tie to the vertical center support for storage.

4. The stool with adjustable handle device of claim 1, wherein the adjustable handle comprises a gripping texture area to provide a non-slip grip for a user.

5. The stool with adjustable handle device of claim 4 wherein the plurality of legs each comprise a wheel to allow the stool component to move freely, as needed.

6. The stool with adjustable handle device of claim 5 further comprising an optional folding back pad that can be secured to the stool component or the adjustable handle for use.

7. The stool with adjustable handle device of claim 1, wherein further comprising at least one storage container.

8. A stool with adjustable handle device that provides a user with a stool manipulated solely by a handle, the stool with adjustable handle device comprising:

a stool component configured in a round base shape with a vertical center support and a plurality of legs arranged in a radial configuration to support the stool component off ground during use; and adjustable handle;

wherein the stool component comprises an exterior surface, an interior surface, and a side edge along a circumference of the stool component;

wherein the stool component is adjustable for height by lengthening or shortening the vertical center support via telescoping action, by a scissor-lift mechanism, or by rotation of a threaded connection;

wherein the adjustable handle is secured to an activator component which acts to engage the telescoping action, the scissor-lift mechanism, or the threaded connection to raise or lower the stool component, as needed;

wherein the adjustable handle comprises a gripping texture area to provide a non-slip grip for a user;

wherein the plurality of legs each comprise a wheel to allow the stool component to move freely, as needed;

wherein the stool component comprises an optional folding back pad that can be secured to the stool component or the adjustable handle for use;

wherein the adjustable handle is secured to the stool component and can act to manipulate the stool component to move and adjust the stool component as needed; and further wherein the stool component and the adjustable handle can be collapsed and compacted for storage.

9. The stool with adjustable handle device of claim 8 further comprising a plurality of indicia.

10. The stool with adjustable handle device of claim 8, wherein the stool component and the adjustable handle are completely collapsible for storage, such that the adjustable handle is telescoped down or folded down, and the vertical center support is shortened, such that the stool component rests against the plurality of legs.

11. The stool with adjustable handle device of claim 10, wherein once in position, the adjustable handle and the stool component are locked into place for storage.

12. The stool with adjustable handle device of claim 11 further comprising a storage hook secured to the stool component to hang the stool with adjustable handle device to a hook on a wall.

13. The stool with adjustable handle device of claim 8, wherein the wheels can be locked in place for safety, to prevent the stool with adjustable handle device from inadvertently rolling.

* * * * *